US011930848B2

(12) United States Patent
Yilmaz et al.

(10) Patent No.: US 11,930,848 B2
(45) Date of Patent: Mar. 19, 2024

(54) AEROSOL GENERATION ARTICLE

(71) Applicant: Nicoventures Trading Limited, London (GB)

(72) Inventors: Ugurhan Yilmaz, London (GB); Mark Potter, London (GB)

(73) Assignee: NICOVENTURES TRADING LIMITED, London (GB)

( * ) Notice: Subject to any disclaimer, the term of this patent is extended or adjusted under 35 U.S.C. 154(b) by 861 days.

(21) Appl. No.: 15/733,506

(22) PCT Filed: Feb. 15, 2019

(86) PCT No.: PCT/EP2019/053821

§ 371 (c)(1),
(2) Date: Aug. 14, 2020

(87) PCT Pub. No.: WO2019/158697

PCT Pub. Date: Aug. 22, 2019

(65) Prior Publication Data

US 2020/0367561 A1 Nov. 26, 2020

(30) Foreign Application Priority Data

Feb. 16, 2018 (GB) ..... 1802590

(51) Int. Cl.
*A24F 40/46* (2020.01)
*A24F 40/44* (2020.01)
(Continued)

(52) U.S. Cl.
CPC ..... *A24F 40/46* (2020.01); *A24F 40/44* (2020.01); *A24F 40/57* (2020.01); *A24F 40/10* (2020.01)

(58) Field of Classification Search
CPC ..... A24F 40/46; A24F 40/44; A24F 40/57; A24F 40/10
(Continued)

(56) References Cited

U.S. PATENT DOCUMENTS 6,516,796 B1 2/2003 Cox et al.
8,910,640 B2 * 12/2014 Sears ..... F22B 1/28 131/194
(Continued)

FOREIGN PATENT DOCUMENTS

AU 2019220433 B2 3/2022
CN 103932401 A 7/2014
(Continued)

OTHER PUBLICATIONS

International Search Report, Application No. PCT/EP2018/053821, dated May 24, 2019, 3 pages.
(Continued)

*Primary Examiner* — Peter G Leigh
(74) *Attorney, Agent, or Firm* — Husch Blackwell

(57) ABSTRACT

There is described an aerosol provision article for use in an aerosol provision system for generating an inhalable medium including an aerosol when a user draws on the aerosol provision system. The aerosol provision article includes at least a first heating element and a second heating element for heating liquid from a liquid reservoir to generate a flow of aerosol; and a region for receiving a substance which, in use, the flow of aerosol passes through and heats the substance before exiting the aerosol provision article, which substance modifies a property of the flow of aerosol. The at least a first heating element and a second heating element are positioned so as to additionally heat the substance in the region.

13 Claims, 2 Drawing Sheets

(51) Int. Cl.
*A24F 40/57* (2020.01)
*A24F 40/10* (2020.01)

(58) Field of Classification Search
USPC ..... 131/329
See application file for complete search history.

(56) References Cited

U.S. PATENT DOCUMENTS

| | | | | |
|---|---|---|---|---|
| 9,078,473 | B2 * | 7/2015 | Worm | A24F 40/50 |
| 2013/0037041 | A1 | 2/2013 | Worm | |
| 2014/0000638 | A1 * | 1/2014 | Sebastian | A24F 40/50 131/328 |
| 2014/0096781 | A1 * | 4/2014 | Sears | A24F 40/50 131/328 |
| 2014/0209105 | A1 | 7/2014 | Sears | |
| 2014/0261486 | A1 * | 9/2014 | Potter | A24F 40/30 131/328 |
| 2015/0320116 | A1 | 11/2015 | Bleloch et al. | |
| 2016/0106153 | A1 | 4/2016 | Zhu | |
| 2016/0262457 | A1 * | 9/2016 | Borkovec | A61M 15/002 |
| 2016/0324216 | A1 * | 11/2016 | Li | A24F 40/30 |
| 2016/0345632 | A1 * | 12/2016 | Lipowicz | H05B 3/16 |
| 2017/0188635 | A1 * | 7/2017 | Force | H05B 1/0244 |
| 2017/0251723 | A1 | 9/2017 | Kobal et al. | |
| 2017/0347706 | A1 | 12/2017 | Aoun et al. | |
| 2017/0347714 | A1 | 12/2017 | Metz et al. | |
| 2018/0007966 | A1 | 1/2018 | Li et al. | |
| 2019/0124982 | A1 * | 5/2019 | Atkins | A24F 40/30 |

FOREIGN PATENT DOCUMENTS

| | | | | |
|---|---|---|---|---|
| CN | 104287098 | A | 1/2015 | |
| CN | 104397875 | A | 3/2015 | |
| CN | 204812043 | | 12/2015 | |
| CN | 204812043 | U * | 12/2015 | |
| CN | 205492620 | | 8/2016 | |
| CN | 205865986 | U | 1/2017 | |
| CN | 107529825 | A | 1/2018 | |
| CN | 107635419 | A | 1/2018 | |
| CN | 206978758 | U | 2/2018 | |
| GB | 2529201 | A | 2/2016 | |
| GB | 2539054 | A * | 12/2016 | A24F 40/40 |
| JP | 2015179388 | A | 10/2015 | |
| JP | 2017506076 | A | 3/2017 | |
| JP | 2017515493 | A | 6/2017 | |
| JP | 2017538398 | A | 12/2017 | |
| KR | 20170073664 | A | 6/2017 | |
| KR | 20180005212 | A | 1/2018 | |
| RU | 2596108 | C1 | 8/2016 | |
| RU | 2603121 | C2 | 11/2016 | |
| RU | 2611487 | C2 | 2/2017 | |
| RU | 2635970 | C2 | 11/2017 | |
| WO | 2013126777 | A2 | 8/2013 | |
| WO | 2015117702 | A1 | 8/2015 | |
| WO | 2016024083 | A1 | 2/2016 | |
| WO | WO 2016090426 | | 6/2016 | |
| WO | 2016135331 | A1 | 9/2016 | |
| WO | WO 2016135342 | | 9/2016 | |
| WO | 2016179376 | A1 | 11/2016 | |
| WO | 2017005471 | A1 | 1/2017 | |
| WO | WO 2017185051 | | 10/2017 | |
| WO | WO 2019081571 | | 5/2019 | |
| WO | 2019158697 | A1 | 8/2019 | |

OTHER PUBLICATIONS

"International Preliminary Report on Patentability received for PCT Patent Application No. PCT/EP2019/053821, dated Aug. 27, 2020", 8 pages.

"International Preliminary Report on Patentability received for PCT Patent Application No. PCT/EP2019/053822, dated Aug. 27, 2020", 8 pages.

"International Search Report received for PCT Patent Application No. PCT/EP2019/053822, dated May 24, 2019", 5 pages.

"Notice of Allowance received for Korean Patent Application No. 10-2020-7023629, dated Nov. 14, 2022", 4 pages (2 pages of English Translation and 2 pages of Official Copy).

"Office Action and Search Report received for Chinese Patent Application No. 2019800132020, dated Feb. 27, 2023", 11 pages (8 pages of English Translation and 3 pages of Official Copy).

"Office action and Search Report received for Chinese Patent Application No. 201980013670.8, dated Nov. 25, 2022", 21 pages.

"Office Action received for Colombian Patent Application No. NC2020/0009879, dated Sep. 19, 2022", 6 pages.

"Office Action received for Japanese Patent Application No. 2020-543225, dated Sep. 14, 2021", 6 pages (3 pages of English Translation and 3 pages of Official Copy).

"Office Action received for Japanese Patent Application No. 2020-543226, dated Sep. 14, 2021", 6 pages (3 pages of English Translation and 3 pages of Official Copy).

"Office Action received for Russian Patent Application No. 2020127217, dated Mar. 4, 2021", 8 pages.

"Office Action received for Ukrainian Patent Application No. 202005197, dated May 9, 2023", 4 pages (Official Copy Only).

"Search Report received for Japanese Patent Application No. 2020-543225, dated Sep. 7, 2021", 17 pages (8 pages of English Translation and 9 pages of Official Copy).

"Search Report received for Russian Patent Application No. 2020127202, dated Mar. 17, 2021", 2 pages.

"Written Opinion received for PCT Patent Application No. PCT/EP2019/053821, dated May 24, 2019", 6 pages.

"Written Opinion received for PCT Patent Application No. PCT/EP2019/053822, dated May 24, 2019", 6 pages.

* cited by examiner

AEROSOL GENERATION ARTICLE

PRIORITY CLAIM

The present application is a National Phase entry of PCT Application No. PCT/EP2019/053821, filed Feb. 15, 2019, which claims priority from GB Patent Application No. 1802590.8, filed Feb. 16, 2018, each of which is hereby fully incorporated herein by reference.

TECHNICAL FIELD

The present disclosure relates to an aerosol provision article for use in an aerosol provision system for generating an inhalable medium.

BACKGROUND

Smoking articles such as cigarettes, cigars and the like burn tobacco during use to create tobacco smoke.

Attempts have been made to provide alternatives to these articles that burn tobacco by creating products that release compounds without burning.

Examples of such products are heating devices which release compounds by heating, but not burning, the material. The material may be for example tobacco or other non-tobacco products, which may or may not contain nicotine.

As another example, there are so-called e-cigarette devices. These devices typically contain a liquid which is heated to vaporize the liquid to produce an inhalable vapor or aerosol. The liquid may contain nicotine and/or flavorings and/or aerosol-generating substances, such as glycerol. The known e-cigarette devices typically do not contain or use tobacco.

As yet another example, there are so-called hybrid devices. These hybrid devices typically contain separately a liquid and tobacco or other flavor material. The liquid is heated to vaporize the liquid to produce an inhalable vapor or aerosol which passes through the tobacco or other flavor material so that a flavor is imparted to the vapor or aerosol.

SUMMARY

According to a first aspect of the present disclosure, there is provided an aerosol provision article for use in an aerosol provision system for generating an inhalable medium comprising an aerosol when a user draws on the aerosol provision system, the aerosol provision article comprising: at least a first heating element and a second heating element for heating liquid from a liquid reservoir to generate a flow of aerosol; and a region for receiving a substance which, in use, the flow of aerosol passes through and heats the substance before exiting the aerosol provision article, wherein the substance modifies a property of the flow of aerosol, wherein the at least a first heating element and a second heating element are positioned so as to additionally heat the substance in the region.

The at least a first heating element and a second heating element may be arranged in a common plane.

The first heating element and the second heating element may be elongate.

The first and second heating elements may be arranged substantially in parallel.

The first heating element and the second heating element may be resistive heating coils.

The first heating element and the second heating element may be substantially linear resistive heating coils.

The first heating element and the second heating element are curved resistive heating coils.

BRIEF DESCRIPTION OF THE DRAWINGS

Embodiments of the disclosure will now be described, by way of example only, with reference to the accompanying disclosure, in which.

DETAILED DESCRIPTION

Figure 1:
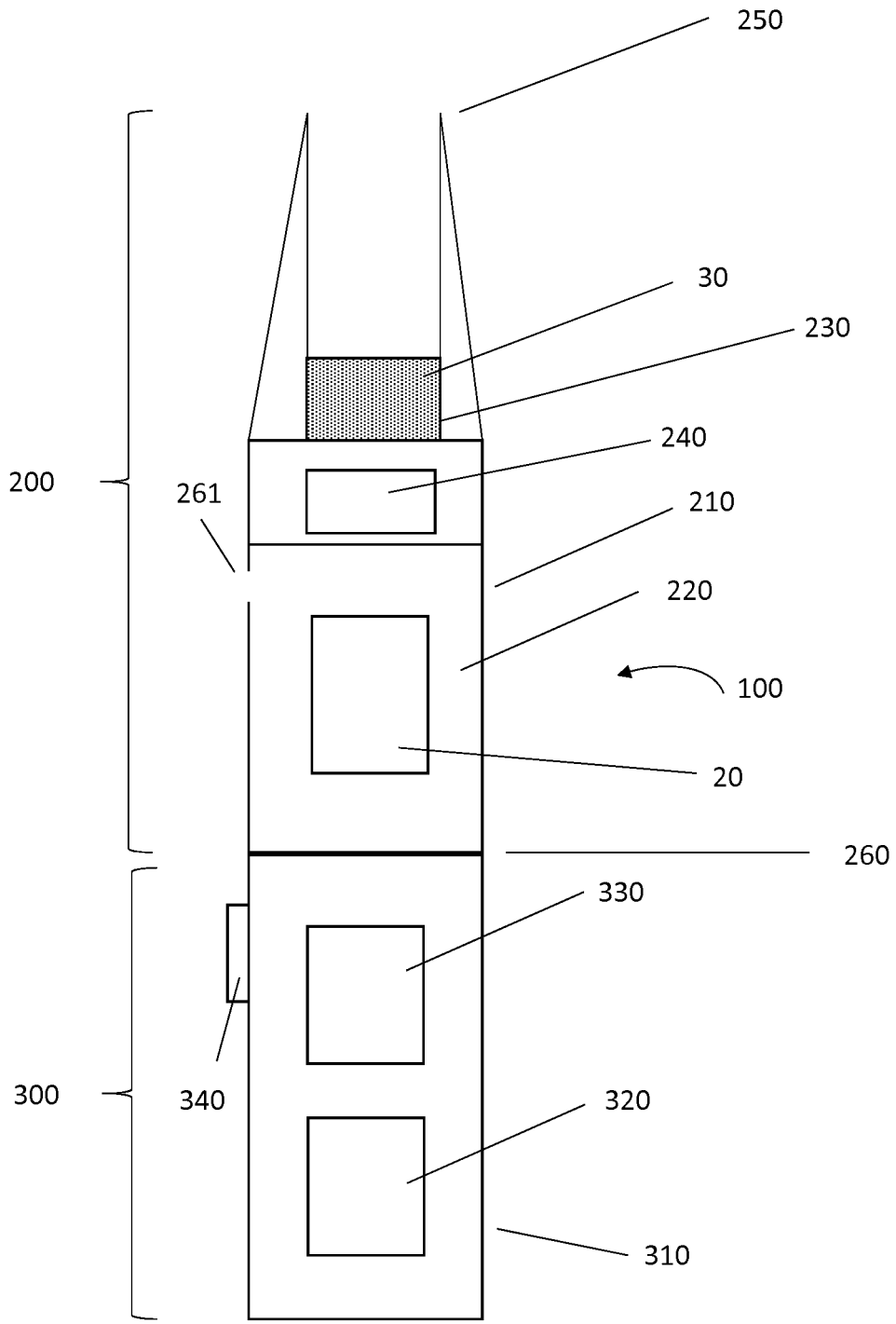
FIG. 1 shows a schematic longitudinal cross-sectional view of a first aerosol provision system for generating an inhalable medium.

Referring to FIG. 1, a schematic of an aerosol provision system 100 is illustrated. The aerosol provision system 100 is an inhalation device (i.e. a user uses it to inhale an aerosol provided by the system 100) and the system 100 is a hand-held system. In this example, the system 100 is an electronic device.

In broad outline, the system 100 volatilizes a liquid 20, for example, an e-cig liquid received in the system 100 to form a vapor and/or an aerosol which passes through a further substance 30 that is also received in the system 100.

In at least some examples a vapor is produced that then at least partly condenses to form an aerosol before exiting the system 100 for inhalation by a user (not shown). The further substance may impart to or modify a property, for example the flavor, of the vapor and/or aerosol before the vapor and/or aerosol passes out of the system 100 for inhalation by a user.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A "colloid" is a substance in which microscopically dispersed insoluble particles are suspended throughout another substance.

For reasons of convenience, as used herein the term aerosol should be taken as meaning an aerosol, a vapor or a combination of an aerosol and vapor.

Returning to FIG. 1, the system 100 of this example comprises an aerosol provision article 200 (which may be referred to as a cartridge) and an aerosol provision device 300. The aerosol provision article 200 is for containing the e-cig liquid 20 and the further substance 30 and the aerosol provision device 300 is for powering and controlling the system 100.

The aerosol provision article 200 comprises a first 'upper' housing 210 and the aerosol provision device 300 comprises a second 'lower' housing 310. In this example, the first housing 210 is releasably connectable to the lower housing 310.

The first housing 210 comprises a liquid reservoir 220 for containing the e-liquid and a region 230 for receiving the further substance 30.

The first housing 210 also contains a heating arrangement 240. The heating arrangement comprises at least a first heating element (not shown in FIG. 1) and a second heating element (also not shown in FIG. 1) for, in use, heating e-cig liquid 20 from the liquid reservoir 220 to generate a flow of aerosol which then passes through the substance 30 before exiting the aerosol provision article 200 when a user draws on the aerosol provision article 200. As the aerosol flow passes through the substance 30 the aerosol flow heats the substance 30 and one or more components of the substance 30 become entrained in the aerosol flow which may modify a property of the flow of aerosol, for example taste.

Advantageously, the first heating element and the second heating element are positioned close enough to the region 230 so that when the heating arrangement heats the liquid to generate a flow of aerosol it also provides additional heat to the substance 30 in addition to the heat provided by the aerosol flow which may enhance the effect the substance 30 has on the aerosol flow.

In some examples, a dimension or size of the region 230, for example, its length and the corresponding dimension or size of the heating arrangement 240, for example the length of each of the first and second heating elements, may be set at a predetermined ratio to optimize the additional heating of the substance 30 by the heating arrangement 240.

The first housing 210 defines the proximal end (or mouth end) 250 which is a mouthpiece of the system 100 and at an opposite end a base section 260 that connects to the second housing 310.

To that end, the base section 260 comprises a connector part, for example, a screw thread or a bayonet fit for releasably connecting the first housing 210 to the second housing 310. The first housing 210 may further comprise one or more air inlets 261.

The second housing 310 contains a power source 320, typically a battery, for powering various components of the system 100, including the heating arrangement 240, to which it is electrically connected, as will be discussed further below.

The battery 320 may be a rechargeable battery or a disposable battery. A controller 330, which may comprise a micro-chip and associated circuitry is also provided in the second housing 310 for controlling the operation of various components of the system 100, as will be discussed further below. A user input means 340, for example one or more control buttons, may be provided on the exterior of the second housing 310 for a user to operate the controller 330.

The liquid reservoir 220 may take various different forms. In one example, the liquid reservoir 220 is in the form of an annular chamber which extends axially in the first housing 210 between the proximal end 250 and the base section 260.

The liquid 20 can be a liquid that is volatilizable at reasonable temperatures, such as in the range of 100-300° C. or more particularly around 150-250° C., as that helps to keep down the power consumption of the system 100. Suitable materials include those conventionally used in e-cigarette devices, including for example propylene glycol and glycerol (also known as glycerine).

Accordingly, in use, as a user draws on the proximal end 250, air is drawn through the one or more air inlets 261. The heater arrangement 240 is powered by the user operating the control button 340 (or alternatively by a puff detector (not shown), as is known per se) and liquid 20 drawn from the liquid reservoir 220 is heated by the heater arrangement 240 to volatilize the liquid 20 to generate aerosol which mixes with air flowing from the air inlet 261 to produce a flow of aerosol. The flow of aerosol is drawn through the substance 30 in the region 230 and then out of the system 100 for inhalation by the user.

In some examples, the substance 30 is a substance that may be used to impart a flavor to the aerosol produced from the liquid 20 as the aerosol passes through the substance 30. The substance 30 may for example consist of or comprise tobacco. As the aerosol passes through and over the tobacco, the aerosol entrains organic and other compounds or constituents from the tobacco material that lend tobacco its organoleptic properties, thus imparting the flavor to the aerosol as it passes through the region 230.

The substance 30 may comprise tobacco per se, different varieties of tobacco, tobacco derivatives, expanded tobacco, reconstituted tobacco, ground tobacco, tobacco extract, homogenized tobacco or tobacco substitutes. In the case of tobacco, the substance 30, etc. may be in the form of a rod of tobacco, a pod or plug of tobacco, loose tobacco, agglomerates, etc., and may be in relatively dry form or in relatively moist form for example. The substance 30 may include other, non-tobacco, products, which, depending on the product, may or may not contain nicotine.

The substance 30 may be for modifying a property of the aerosol other than (or in addition) to flavor.

In some examples, the substance 30 may be or include a substance that modifies one or more other organoleptic properties of the aerosol (e.g. modifying the feel or smell or look of the aerosol to the user).

In some examples, the substance 30 may be or include a substance that modifies the PH of the aerosol by either lowering or raising the PH (e.g. modifying the acidity or the basicity of the aerosol).

In some examples, the substance 30 may be or include a substance that modifies (e.g. reduces) the amount of aldehydes in the aerosol.

In some examples, the substance 30 may be or include a substance that modifies different combinations of two or more of these or indeed other properties of the aerosol flow.

It will be understood however that materials other than tobacco may be used to impart different flavors to the aerosol.

If the substance 30 is or includes tobacco, it may be that the aerosol stream draws sufficient nicotine from the substance 30. Alternatively or additionally, if the substance 30 does not contain any tobacco, the substance 30 may be enhanced with nicotine, for example by coating the material with nicotine. Indeed, even in the case that the substance 30 is or includes tobacco, the substance 30 may be coated or otherwise enhanced with nicotine. As another example, whether or not the substance 30 is or includes tobacco and/or includes nicotine, nicotine may be provided in the liquid 20. Accordingly, where it is intended that the system 100 provides nicotine for the user, the nicotine may be provided in the liquid 20, may be obtained from the substance 30 in the case that the material is or includes tobacco, may be provided as a coating or the like on the substance 30 if it is non-tobacco material, may be provided as a coating or the like on the substance 30 if it is tobacco material, or any combination of these. Likewise, flavorings may be added to the substance 30 (whether or not the substance is or includes tobacco) and/or to the liquid 20.

In some examples, it may be that the user only needs to top up or replace the substance 30 from time to time, with sufficient liquid 20 being provided for several uses. Once the liquid 20 has been consumed, the user disposes of the aerosol provision article 200 and then uses a new one.

In other examples, the housing 210 is not designed to be disposable and instead the user only needs to top up or replace the liquid 20 from time to time.

In some examples, the aerosol provision article 200 and the aerosol provision device 300 are integrated in a single device and are not arranged to be detachable from each other.

Providing the additional heating of the substance 30 may be an important factor in providing the user with a satisfactory sensory experience. For example, if the substance 30 comprises tobacco, then the additional heating of the tobacco may increase the tobacco taste amplitude experienced by a user and may cause more constituents such as nicotine to become entrained in the flow of aerosol than if the heating were provided by the flow of aerosol alone.

Using a heating arrangement that comprises at least a first heating element and second heating element that are arranged to heat the substance 30 provides for an efficient heat transfer to the substance 30 and enables a relatively large surface area of the substance 30 to be heated. Additionally, the power consumed per heating element may be less than would need to be consumed by an element in a heating arrangement in which that element was the only element.

In some examples, the at least a first heating element and second heating element are selectively operable independently of each other.

Figure 2A:
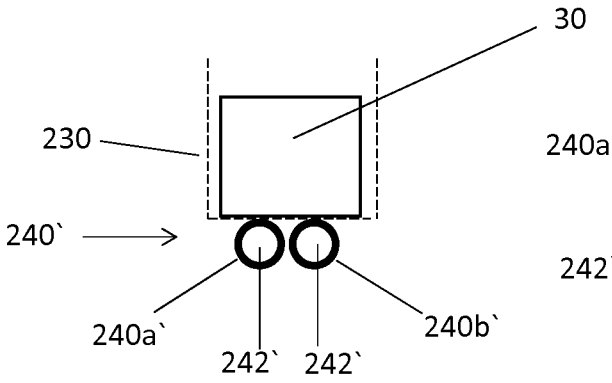
FIG. 2*a* shows a schematic longitudinal cross-sectional view of a first heating arrangement for the aerosol provision system of FIG. 1.
Figure 2B:
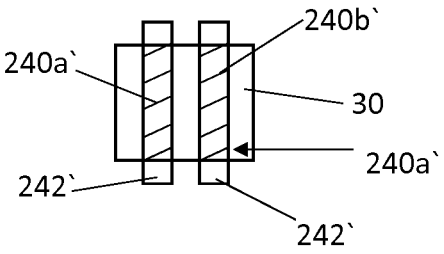
FIG. 2*b* shows a schematic plan view of the first heating arrangement.

Referring now to FIGS. 2*a* and 2*b*, a first example of a heating arrangement 240' suitable for use as the heating arrangement 240 in the aerosol provision article 200 of FIG. 1 in order to heat liquid 20 from the liquid reservoir 220 and to heat the substance 30 in the region 230 is schematically illustrated.

In this example, the heating arrangement 240' comprises at least a first heating element 240*a*' and a second heating element 240*b*' that each can heat liquid 20 from the liquid reservoir 220 to generate an aerosol flow and which can also heat the substance 30 in the region 230 through which the aerosol flow flows.

In this example, the first heating element 240*a*' and the second heating element 240*b*' are located adjacent to the region 230 slightly beneath the base of the region 230. Accordingly, the first heating element 240*a* and the second heating element 240*b*' are located close enough to the region 230 so as to be able to heat and raise the temperature of the substance 30 when the first heating element 240*a* and the second heating element 240*b*' are activated.

The at least a first heating element 240*a* and a second heating element 240*b*' are arranged in a common plane which, in this example, is substantially parallel to the base of the region 230. This arrangement facilitates a uniform heating of the substance 30 in the region 230.

The first heating element 240*a* and the second heating element 240*b*' may be elongate and arranged substantially in parallel, again to ensure a uniform heating of the substance 30 in the region 230.

Each of the first heating element 240*a*' and the second heating element 240*b*' may be an electrically resistive heater, including for example a nichrome resistive heater, a ceramic heater, etc. In the example illustrated in FIGS. 2*a* and 2*b*, the first heating element 240*a* and the second heating element 240*b*' is a wire, which is in the form of a coil.

In alternative examples, each of the first heating element 240*a*' and the second heating element 240*b*' may be in the form of a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc.

Other heating arrangements may be also used for the first heating element 240*a*' and the second heating element 240*b*', including non-electrical heating arrangements, or other electrical heating arrangements, for example, each of the first heating element 240*a*' and the second heating element 240*b*' may be an induction heating element.

In the example shown in FIGS. 2*a* and 2*b*, the first heating element 240*a*' and the second heating element 240*b*' are substantially linear (i.e. straight) resistive heating coils and each surrounds a respective wick 242' which is in thermal contact with its heating element 240*a*' or 240*b*'. The wicks 242' are also in fluidic contact with the liquid 20 contained in the liquid reservoir. The wicks 242' are generally absorbent and act to draw in liquid 20 from the liquid reservoir 220 by capillary action.

The wicks 242' can be non-woven and may be for example a cotton or wool material or the like, or a synthetic material, including for example polyester, nylon, viscose, polypropylene or the like, or a ceramic material.

In some examples, the control circuitry 330 is configured to be able to independently control the activation of the first heating element 240*a* and the second heating element 240*b'*.

In these examples, the control circuitry 330 may be configured to be able to activate one of the first heating element 240*a*' and the second heating element 240*b*' while the other of the first heating element 240*a*' and the second heating element is in-active 240*b'*.

Figure 3:
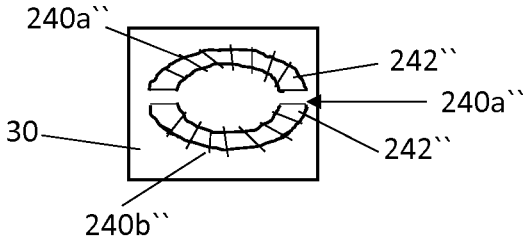
FIG. 3 shows a schematic plan view of a second heating arrangement for the aerosol provision system of FIG. 1.

Referring now to FIG. 3, there is illustrated another example of a heating arrangement 240" suitable for use as the heating arrangement 240 in the aerosol provision article 200 of FIG. 1.

The heating arrangement 240" is similar to the heating arrangement 240' described with respect to FIG. 2 and similar elements have been given the same reference numerals but carry an additional '.

In this example each of the first heating element 240*a*" and the second heating element 240*b*" is a non-linear coil (i.e. the coil is curved). Likewise, each of the wicks 242" is also non-linear.

In this particular example, each heating element 240*a*" and 240*b*" and its respective wick 242" is generally 'C' shaped with the ends of the C shape opposing each other with a small gap G between them.

In use, and particularly in the case that the substance 30 is tobacco, it can be advantageous that the tobacco, or at least the surface of the tobacco, be heated to a temperature of between around 190° C. to 210° C., for example around 200° C., so as to ensure that an adequate or appropriate amount of the compounds are released from the tobacco.

The amount of tobacco present may be for example in the range 50 to 300 mg or so. A most suitable value for the amount of tobacco may be for example in the range 50 to 150 mg, with 130 mg being a value that is currently found to be particularly suitable in some applications. In a typical example, the amount of tobacco that is heated per operation of the system (i.e. per puff) may be in the corresponding range of around 8 to 50 mg.

In the examples described above, the heating arrangement 240 is between the region 230 and the liquid reservoir 220. Other arrangements are possible, for example, the liquid reservoir 220 may be to one side of or on both sides of the heating arrangement 240.

In the examples discussed above, there is small gap between the heating arrangement 240 and the region 230. This is not essential and so in some examples the heating arrangement 240 may touch the substance 30 in the region 230.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In order to address various issues and advance the art, the entirety of this disclosure shows by way of illustration and example various embodiments in which the claimed invention may be practiced and which provide for a superior system arranged to generate an inhalable medium. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An aerosol provision article for use in an aerosol provision system for generating an inhalable medium comprising an aerosol when a user draws on the aerosol provision system, the aerosol provision article comprising:

at least a first heating element and a second heating element for heating liquid from a liquid reservoir to generate a flow of aerosol; and a region for receiving a substance which, in use, the flow of aerosol passes through and heats the substance before exiting the aerosol provision article, wherein the substance modifies a property of the flow of aerosol, wherein the at least the first heating element and the second heating element are positioned so as to additionally heat the substance in the region, wherein the at least the first heating element and the second heating element are arranged in a common plane, wherein the common plane is substantially parallel to a base of the region.

2. The aerosol provision article according to claim 1, wherein the first heating element and the second heating element are elongate.

3. The aerosol provision article according to claim 1, wherein the first heating element and the second heating element are arranged substantially in parallel.

4. The aerosol provision article according to claim 1, wherein the first heating element and the second heating element are resistive heating coils.

5. The aerosol provision device according to claim 4, wherein the first heating element and the second heating element are substantially linear resistive heating coils.

6. The aerosol provision device according to claim 4, wherein the first heating element and the second heating element are curved resistive heating coils.

7. The aerosol provision article according to claim 1, comprising a wick arrangement for transporting liquid from the liquid reservoir to the first heating element and to the second heating element.

8. The aerosol provision article according to claim 7, wherein the wick arrangement comprises a first wick for transporting liquid from the liquid reservoir to the first heating element and a second wick for transporting liquid from the liquid reservoir to the second heating element.

9. The aerosol provision article according to claim 8, wherein one of the first heating element and the second heating element may be activated when the other of the first heating element and the second heating element is inactive.

10. The aerosol provision article according to claim 1, wherein the first heating element and the second heating element are independently controllable of each other.

11. The aerosol provision device according to claim 1, further comprising the liquid reservoir for containing the liquid.

12. An aerosol provision system for generating an inhalable medium comprising an aerosol, the system comprising:

the aerosol provision article of claim 1; and an aerosol provision device comprising a control for controlling the at least the first heating element and the second heating element.

13. The aerosol provision system according to claim 12, wherein the aerosol provision article and the aerosol provision device are releasably connectable together.

* * * * *